US007669407B2

(12) United States Patent
Winsor

(10) Patent No.: US 7,669,407 B2
(45) Date of Patent: Mar. 2, 2010

(54) CATALYTIC CLEANING OF BLOWBY GASES

(75) Inventor: Richard Edward Winsor, Waterloo, IA (US)

(73) Assignee: Deere & Company, Moline, IL (US)

( * ) Notice: Subject to any disclaimer, the term of this patent is extended or adjusted under 35 U.S.C. 154(b) by 207 days.

(21) Appl. No.: 11/598,350

(22) Filed: Nov. 13, 2006

(65) Prior Publication Data

US 2008/0110156 A1 May 15, 2008

(51) Int. Cl.
*F01N 3/00* (2006.01)

(52) U.S. Cl. ..... 60/283; 60/274; 60/282; 60/286; 60/300; 60/303; 123/41.86; 123/74 AE; 123/573

(58) Field of Classification Search ..... 60/274, 60/284, 286, 300, 303, 232, 283, 282; 123/41.86, 123/74 AE, 572, 573
See application file for complete search history.

(56) References Cited

U.S. PATENT DOCUMENTS 3,263,412 A * 8/1966 Thompson ..... 60/283
3,818,875 A * 6/1974 Phillips et al. ..... 123/25 E
3,846,980 A * 11/1974 DePalma ..... 60/279
4,993,225 A * 2/1991 Giacomazzi et al. ..... 60/283
5,271,906 A * 12/1993 Yuuki et al. ..... 422/177
5,388,406 A * 2/1995 Takeshima et al. ..... 60/297
5,784,878 A * 7/1998 Kato et al. ..... 60/274
5,966,931 A * 10/1999 Yoshizaki et al. ..... 60/284
6,052,988 A * 4/2000 Ikeda ..... 60/284
6,151,890 A * 11/2000 Hoshi ..... 60/297
6,235,254 B1 * 5/2001 Murphy et al. ..... 423/212

* cited by examiner

*Primary Examiner*—Binh Q Tran

(57) ABSTRACT

An assembly for cleaning blowby gases has an electric heater and a downstream catalyst positioned in series relationship in a blowby conduit leading from an engine's crankcase to the atmosphere. The heater is controlled by a controller to maintain a selected temperature at the inlet to the catalyst as determined by a temperature sensor. The heating of the blowby gases increases the blowby gas temperature to a level where the catalyst is active to oxidize the constituents of the blowby gas stream.

22 Claims, 1 Drawing Sheet

CATALYTIC CLEANING OF BLOWBY GASES

FIELD OF THE INVENTION

The present invention relates to internal combustion engines and more particularly to the treatment of blowby gases from such engines.

BACKGROUND OF THE INVENTION

Reciprocating internal combustion engines have a series of pistons reciprocating in appropriate cylinders. These pistons are connected to a crankshaft to translate the reciprocating movement to a rotary output. All reciprocating internal combustion engines have some degree of gases that pass by the pistons from the combustion chamber to an interior chamber for the engine, usually called the crankcase.

Internal combustion engines of the heavy duty diesel type, where the heat of intake air compression is used to ignite fuel that is injected by a fuel injection system at, or near the end of the compression stroke to provide combustion and a power output have greater issues with blowby gases. Such engines are typically turbocharged so that the charge at the beginning of the compression stroke can be above atmospheric pressure. This and other factors such as the normal high compression of the diesel engine cause blowby gases to pass from the cylinder past the piston into a crankcase that houses the crankshaft and other working mechanisms for the engine.

In the past, blowby gases have been vented directly to the atmosphere. The reason for this is that it is not possible to contain the gases in the crankcase because pressure would eventually build up and cause leakage through various seals and other gaskets.

Recent proposals in the emissions laws have mandated that blowby gas (also called crankcase ventilation gases) must be included as part of the regulated emissions. This means that any product of the fluids coming from the crankcase must be either treated or somehow dealt with. One approach has been to direct the blowby gas into the inlet of a turbocharger compressor so that the blowby gas is mixed with the fresh air and consumed by the combustion process of the engine. However, since the blowby gases have oil particles as well as unburned hydrocarbons, the entry of these gases into the compressor inlet can cause a deposit on the compressor. In cases where a high pressure ratio compressor is used for the turbocharger, the discharge temperature of the compressor may be high enough to cause coking.

Other manufacturers have used elaborate liquid separation and filtration devices to remove the emissions. Using filtration devices, requires periodic replacement which in turn increases the complexity and cost to maintain the engine. Even when the bypass flow is filtered, it does not completely eliminate the emissions of components of the bypass flow that are subject to regulation.

Thus, a need exists in the art to provide a cleaning of the fluids passing through the bypass flow passageway.

SUMMARY OF THE INVENTION

In one form, the invention includes a blowby assembly for an internal combustion engine having a combustion chamber and an internal chamber exterior to the combustion chamber. The assembly includes a passageway for fluid leading from the internal chamber to the atmosphere and a catalyst is positioned in the passageway. A heater is positioned in the passageway between the catalyst and the internal chamber.

In another form, the invention includes an internal combustion engine having a housing and a plurality of pistons reciprocable within the housing in associated combustion chambers. The pistons are connected to a crankshaft journaled within the housing to provide a rotary output. The housing has an internal chamber exterior to the combustion chamber and the engine has a passage for fluids from the internal chamber to the atmosphere. A catalyst is positioned in the passage so that fluid passing from the internal chamber to the atmosphere passes over the catalyst. A heater is positioned in the passage between the catalyst and the housing for heating the fluid passing to the catalyst.

In yet another form the invention includes a method for cleaning blowby gas from an internal combustion engine which has a passage leading the blowby gas to the atmosphere. The method has the steps of heating the blowby gas in the passage and then passing the heated blowby gases over a catalyst before passing to the atmosphere.

DETAILED DESCRIPTION OF THE INVENTION

Figure 1:
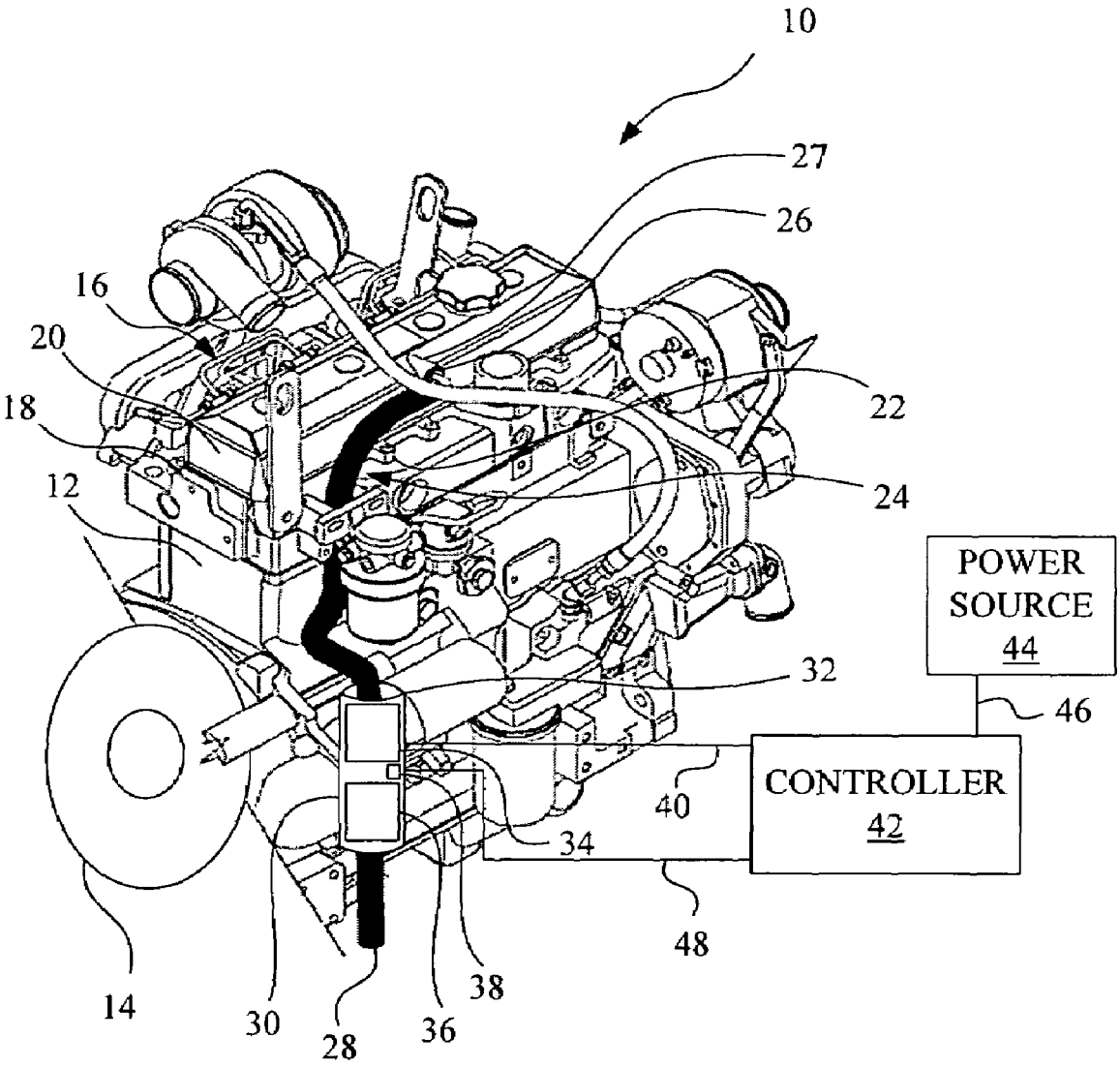
FIG. 1 shows an external perspective view of an internal combustion engine and a blowby gas cleaning assembly embodying the present invention along with schematic representation of associated components.

The sole FIG. 1 shows an internal combustion engine generally indicated by reference character 10. Internal combustion engine 10 has an engine crankcase 12 in which a series of cylinder liners (not shown) receive pistons (also not shown) that reciprocate and are connected to a crankshaft which provides a rotary output through flywheel 14. As herein shown, engine 10 is of the compression engine, or diesel type, in which the heat of compression is used to ignite fuel that is injected into combustion chambers from a fuel injection system 16. Fuel injection system 16 may be one of a number of types including hydromechanical, high pressure common rail, or unit injectors. These fuel systems all have, as their object, the metering of the correct quantity at the correct time to provide demanded power from engine 10 while still maintaining emissions output within limits established by local and national regulatory bodies, as appropriate for the engine application.

As discussed before, diesel engines have a bypass flow of gases from the combustion chamber of the engine. The blowby gases are a normal part of the engine operating cycle and are caused by piston ring reversals and passage of gases across the end gaps of piston rings. The blowby gases travel from the combustion chamber past the piston to an internal chamber (not shown) in engine 10. Part of the chamber includes the lower portion of crankcase 12 which houses the connecting rod, crankshaft, and sump for the engine 10. As is typical practice, the chamber within the block 12 extends to a head 18 which has a set of rocker levers or other camshaft mechanism for actuating poppet valves within the engine to admit intake air and permit the discharge of exhaust air from the combustion chamber. Head 18 is covered by a rocker cover 20 and the space bounded by rocker cover 20 and head 18 is connected to the chamber within engine block 12 by appropriate passages. Usually these passages include passages for pushrods going down to a lower mounted camshaft, in addition to defined paths for oil from the rocker cover 20 to the sump in the lower portion of crankcase 12. The interior of housing of rocker cover 20, and therefore the internal chamber of the engine 10, is vented to atmosphere by a passage 22 within a conduit 24 connected to an opening 26 on rocker cover 20. Conduit 24 extends to a lower portion of the engine and has an opening 28 that vents the internal chamber to the atmosphere. A component 27 is positioned in the rocker cover 20 to block the flow of large droplets of oil from entering the passage 22. This may be in the form of a circuitous path through a series of baffles or a wire mesh. It should be apparent to those skilled in the art that other methods may be used to prevent large droplets from entering the passage 22.

A housing 30 is interposed in conduit 24 so that all the fluid flow in passage passes through the housing 30. A heater 34 is positioned at the upstream end 32 of chamber 30. A catalyst 36 is positioned downstream of heater 34 and a temperature sensor 38 is between the two, but closely adjacent catalyst 36. Heater 34 can be a typical resistance heater that receives power via line 40 from a controller 42. Controller 42 receives power from an appropriate power source 44 via line 46. Power source 44 typically would be the engine/vehicle electrical system. Typically, the power source would be DC voltage at the level appropriate for the vehicle's electrical system. The controller 42 directs current to heater 34 via the line 40 to heat fluids passing through conduit 24 to a temperature at which the catalyst 36 is active. In order to provide a closed loop to the control system, the signal from the temperature sensor 38 is fed to the controller 42 via line 48. The details of such a control scheme are not discussed in order to simplify the understanding of the present invention. It should be apparent, however, that the control may be implemented in analog or digital form to provide the appropriate control of the temperature of the fluid passing in and over the catalyst 36.

The catalyst material may be selected from the precious metals consisting of platinum, palladium, and a combination of both. It should be apparent to those skilled in the art that other catalyst materials may be selected with equal applicability.

The impact of heater 34 is that it heats the fluids in passage 22 from a temperature of around 100° C. to at least 200° C. and preferably 250° C. so that the catalyst 36 is able to act on the blowby gases to oxidize the constituents in the bypass conduit prior to discharge to the atmosphere through opening 28. The blowby is in an aerosol form consisting mainly of small oil droplets with some carbon and traces of wear debris and fugitive dust. Particle sizes range from 0.1 to 3 micrometers with most of the mass distribution falling between 0.5 to 2 micrometers. The particle distribution is such that the aerosol is highly likely to be inhaled by humans. By heating the gases to the temperatures indicated, the catalyst 36 oxidizes the hydrocarbons and the lube oil to minimize, if not eliminate, the aerosol from those components being discharged to the atmosphere.

The capacity of the heater is dependent on engine conditions and especially engine displacement. The capacity of the heater can vary up to about 500 watts on a 9 liter engine. It should be apparent to those skilled in the art, however, that the engine may be provided in other forms and would require heaters of different capacity. Such a system eliminates the need for a complex filtration system and subsequent cleaning and/or replacement of such a filter.

Having described the preferred embodiment, it will become apparent that various modifications can be made without departing from the scope of the invention as defined in the accompanying claims.

The invention claimed is:

1. A blowby assembly for an internal combustion engine having a combustion chamber and an internal chamber exterior to the combustion chamber, said assembly comprising:

a passageway for fluid leading from said internal chamber to the atmosphere and not connected to said combustion chamber;

a catalyst positioned in said passageway; and a heater positioned in said passageway between said catalyst and the internal chamber.

2. The blowby assembly as claimed in claim 1, wherein said heater heats the fluid in said passageway to a temperature at which the catalyst is active.

3. The blowby assembly as claimed in claim 2, wherein said heater heats the fluid in said passageway to approximately 200° C.

4. The blowby assembly as claimed in claim 2, further comprising a control unit for controlling the extent to which said heater heats fluid in said passageway.

5. The blowby assembly as claimed in claim 4, further comprising a temperature sensor between said heater and said catalyst and at least adjacent said catalyst, said sensor providing a temperature signal to said control unit for regulating the temperature of said catalyst.

6. The blowby assembly as claimed in claim 1, wherein the material of said catalyst is selected from the group consisting of platinum, palladium and a combination of platinum and palladium.

7. The blowby assembly as claimed in claim 1, wherein the fluid flow through said passageway is up to 10 $m^3$/hr and said heater heats at a capacity of up to 500 watts.

8. The blowby assembly as claimed in claim 1, wherein said heater and said catalyst are in a single housing.

9. An internal combustion engine comprising:

a housing;

a plurality of pistons reciprocable within said housing in associated combustion chambers, said pistons being connected to a crankshaft journaled within said housing to provide a rotary output;

said housing having an internal chamber exterior to said combustion chambers;

a passage for fluids from said internal chamber to the atmosphere and not connected to said combustion chamber;

a catalyst positioned in said passage so that fluid passing from said internal chamber to the atmosphere passes over said catalyst; and a heater positioned in said passage between said catalyst and said housing for heating the fluid passing to the catalyst.

10. The internal combustion engine as claimed in claim 9, wherein said heater heats the fluid in said passage to a temperature at which said catalyst is active.

11. The internal combustion engine as claimed in claim 10, wherein said heater heats the fluid to approximately 200° C.

12. The internal combustion engine as claimed in claim 11, further comprising a control unit for controlling said heater to heat the fluid in said passageway.

13. The internal combustion engine as claimed in claim 12, further comprising a temperature sensor in said passage between said heater and said catalyst, said temperature sensor positioned adjacent said catalyst and providing a signal to said control unit to control said heater.

14. The internal combustion engine as claimed in claim 9, wherein said catalyst material selected from the group consisting of platinum, palladium and a combination of platinum and palladium.

15. The internal combustion engine as claimed in claim 9, wherein the fluid flow through said passages is up to 10 $m^3$/hr and said heater has a capacity of up to 500 watts.

16. The internal combustion engine as claimed in claim 9, wherein said heater and said catalyst are in a single housing.

17. The internal combustion engine as claimed in claim 9, further comprising a component between said internal chamber and said passageway to prevent droplets of oil from entering said passageway.

18. A method for cleaning blowby gas from an internal combustion engine having a passage leading the blowby gas to the atmosphere and not connected to the engine combustion chamber, said method comprising the steps of:

heating blowby gas in said passage; and passing said heated blowby gas over a catalyst before it passes to the atmosphere.

19. The method as claimed in claim 18, wherein said blowby gas is heated to a temperature at which said catalyst is active.

20. The method as claimed in claim 18, wherein said blowby gas is heated to a temperature of 200° C.

21. The method as claimed in claim 18, wherein said blowby flow rate is up to 10 $m^3$/hr and the rate of heating is up to 500 watts.

22. The method as claimed in claim 18, wherein said catalyst material is selected from the group consisting of platinum, palladium, and a combination of platinum and palladium.

* * * * *